United States Patent [19]

Hayes

[11] 4,357,006

[45] Nov. 2, 1982

[54] DISTORTION FREE 3 POINT VACUUM FIXTURE

[75] Inventor: Lawrence P. Hayes, Berlin, Vt.

[73] Assignee: International Business Machines Corporation, Armonk, N.Y.

[21] Appl. No.: 210,936

[22] Filed: Nov. 28, 1980

[51] Int. Cl.[3] ..... B25B 11/00

[52] U.S. Cl. ..... 269/21; 51/235; 83/451; 269/296; 279/3; 408/76

[58] Field of Search ..... 269/21, 296, 310; 83/451; 279/3; 408/76; 51/235, 166 R; 248/362, 363

[56] References Cited

U.S. PATENT DOCUMENTS

| | | | |
|---|---|---|---|
| 799,922 | 9/1905 | Moxham | 269/21 X |
| 2,529,331 | 11/1950 | Ellis et al. | 279/3 |
| 2,701,723 | 2/1955 | Ekberg | 279/3 |
| 2,729,040 | 1/1956 | Wallace et al. | 51/235 |
| 2,730,370 | 1/1956 | Brewster | 279/3 |
| 2,782,574 | 2/1957 | Copold | 51/235 |
| 3,084,928 | 4/1963 | Opitz | 269/21 |
| 3,116,919 | 1/1964 | Alth | 269/21 |
| 3,484,093 | 12/1969 | Mermelstein | 269/21 |
| 4,088,312 | 5/1978 | Frosch et al. | 269/21 |

*Primary Examiner*—Frank T. Yost

*Attorney, Agent, or Firm*—Francis J. Thornton

[57] ABSTRACT

This is a vacuum clamp for holding workpieces which assures that the workpiece is held without distortion. This is accomplished by providing a fixed support, with a convex surface, and a flexible seal around the fixed support so that when a vacuum is drawn within the seal the workpiece being held abuts the fixed support tangentially. The convex surface of the support does not force the workpiece to conform to the surface of the support as it would if the surface of the support were flat.

6 Claims, 6 Drawing Figures

DISTORTION FREE 3 POINT VACUUM FIXTURE

DESCRIPTION OF THE INVENTION

This invention relates generally to work holding devices and more particularly to vacuum operated apparatus for holding work in a preferred position.

Many work holding devices are known to the prior art and many employ vacuum clamping means. More particularly, some of those vacuum clamps employ a soft seating member on the surface of the clamp to assure a good vacuum seal between the article being clamped and the surface of the clamp. Thus the workpiece is pulled tightly to the surface of the clamp by the vacuum. When the clamp surface is large or when a number of clamps are used to hold the workpiece the vacuum forces the workpiece to assume a fixed position determined by the surface of the clamp or by the surface defined by the number of clamps. Thus, the characteristic normal shape of the workpiece can be altered by the action of the clamps.

The present invention is concerned with this distortion problem and provides an improved vacuum clamp or work holding device.

The principal object of this invention is to provide a vacuum clamp that will not substantially alter the characteristic normal shape of the workpiece.

It is another object of the invention to provide a vacuum clamp that can be used to hold a wide variety of workpieces in various tools or positions without distortion.

It is further an object of the invention to provide a vacuum clamp that will effectively conform to the shape of the workpiece being held.

SUMMARY OF THE INVENTION

Broadly speaking the present invention is directed to a vacuum clamp comprising a base, a vertical member having a convex upper surface, a flexible sealing member around said vertical member and a passage in the base and inside said sealing member so that a vacuum may be drawn in said sealing member as to hold a workpiece without distortion.

More specifically, there is described a vacuum operating clamp for holding a workpiece comprising,

- workholding members disposed on a base,
- each of said workholding members having a convex upper surface,
- a flexible sealing member on each of said workholding members around said surface,
- means adapted to support the upper edge of the sealing member above said convex upper surface, and
- vacuum means passing through the member through which a vacuum may be drawn between a workpiece overlying said flexible sealing member and said convex surface whereby said work is clamped onto and supported tangentially to said convex surface of said element without distortion.

These and other objects and features of the present invention will be more fully understood and appreciated from the following description of several different embodiments.

DESCRIPTION OF THE PRESENT INVENTION

Figure 1:
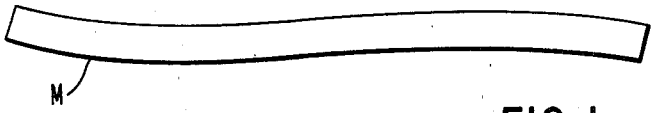
FIG. 1 is the side view of a thin workpiece having surface variations therein.

Shown in FIG. 1 is a workpiece comprising a typical mask M used in the semiconductor industry in the production of integrated circuits. Such masks are often formed of glass plates approximately 0.125 inches thick and about four inches on a side. Of course, such masks may be larger or smaller than this example.

Although to the naked eye these plates appear flat they can in fact have quite irregular surfaces. In FIG. 1, for purposes of illustration only, these irregularities are shown greatly exagerated.

Figure 2:
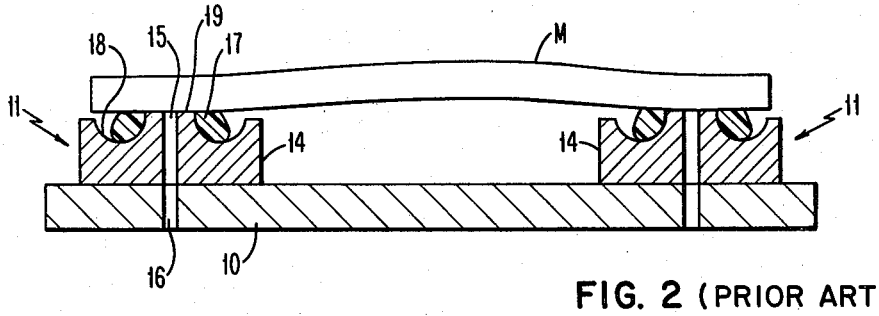
FIG. 2 (PRIOR ART)
FIG. 2 illustrates the mask of FIG. 1 clamped on a stand using the prior art clamps.

When such a mask is held fast using the clamps of the prior art as shown in FIG. 2 the mask is forced to conform to the clamps and the natural shape of the mask is lost. The fixture of FIG. 2 comprises a base member 10 having a plurality of clamps 11 mounted thereon, of which only two are shown. Each clamp comprises a cylindrical body member 14 having a conduit 15 passing therethrough. This conduit mates with a conduit 16 in the base member 10. This conduit 16 is coupled to a conventional vacuum pump as shown.

As is well known to those skilled in the art, the conventional mode of operation of such a vacuum-operated device is to locate a workpiece against the face of the chuck and then remove air from between the members, thereby enabling atmospheric pressure to hold the parts against one another. A sealing ring 17, comprised of an elastic material, such as rubber, plastic, or the like, and constructed of toric cross-section, such as is commonly represented by the article sold in the trade as an O ring, is mounted in a groove 18 formed in the top flat surface 19 of the workholding clamp 14. This groove 18 which may be of varying circumferential characteristics. The dimensional characteristics of this groove are chosen such that the diameter of the groove at points therein, is greater than the diameter of the sealing ring and the volume of the groove is sufficient to accept the total volume of the O ring.

When the mask M is placed over the clamps, as shown in FIG. 2 and a vacuum is drawn by a source (not shown) through the conduit 15 and 16, the air is removed from between the mask and the top surface 19 of the clamp within the confines of the O ring 17 causing the lower surface of mask to be pulled tight against the O ring. This crushes the O ring and forces it to conform to the groove 18. Because O ring 17 is soft and pliable it continues to be crushed until the mask presses against the top surface 19. Indeed in the prior art the groove 18 was designed to be larger than the total volume of the ring 17 thus permitting the mask M is pulled tight against the surface 16 of the clamp. When this happens the natural shape of mask is distorted for the mask is made to conform to the flat surface 19 of the clamp. This is readily seen when the shape of the mask of FIG. 2 is compared with the shape of the mask of FIG. 1. Thus, the natural shape of the mask M has been altered by the clamps of the prior art.

The present invention avoids this very significant problem. This can best be seen in FIG. 3 where there is illustrated a base plate 30 carrying a plurality of clamps 31 embodying the present invention. Although only two such clamps are shown it should be understood that any number of such clamps could be used. Each clamp comprises a hollow cylindrical body 32 in the center of which is a post 33 having a rounded convex top 34 which extends above the top surface 38 of the cylinder 32. A vacuum port 35 communicates with the hollow center of the clamp. A sealing ring 36 comprised of elastic material such as rubber, etc., i.e. an O ring, is provided in a groove 37 that is formed in the top surface 38 of the body 32 concentric with the post 33 and the hollow center of the cylinder 32.

It should be noted that the groove 37 is large enough to permit the O ring 36 to be fully compressed therein.

In its uncompressed or relaxed condition the O ring must be of a diameter sufficient to cause its top surface to be substantially higher than the top surface of the rounded top 34 of the post 33. In one model actually built the top surface of the O ring extended 0.005 inches above the surface of rounded top 34 and the O ring was nominally 0.5 inches in diameter and 0.125 inches in cross-sectional diameter, i.e. thickness and the groove in which the O ring was seated was 0.01 inches deep.

With this clamp when a vacuum source (not shown) draws a vacuum through the conduct 35 the air is removed from the inside, i.e. the internal cavity, of the hollow cylinder 32 and the mask M is pulled down against the flexible ring 36 in this case, however, the mask compresses the ring 36 until the mask abuts tangentially the rounded top 34 of the post 33. When the mask abuts the rounded top 34 further compression of the ring is prevented and, as shown in FIG. 3, the mask M remains undistorted.

The projection of the convex top 34 of the post 33 above the top surface 38 of the cylinder 32 prevents the mask M from being clamped hard against the top surface 38 of the cylinder 32 and thus prevents distortion in the mask.

Figure 3:
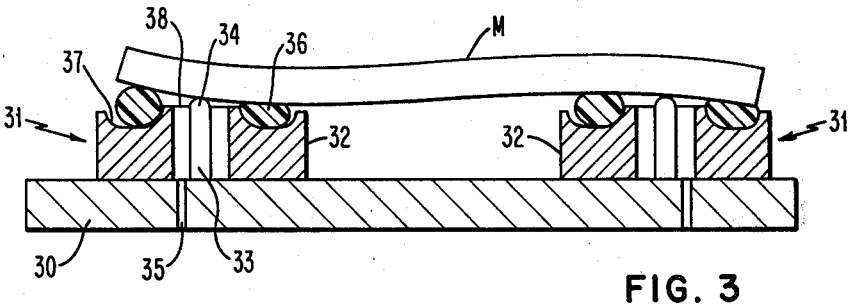
FIG. 3 illustrates the mask of FIG. 1 clamped on a stand using clamps embodying the present invention.

As shown in FIG. 3, the right side of the O ring 36 is significally compressed due to the distortion in the mask M but the left side of the O ring 36 is compressed only slightly because the post 33 stops the downward travel of the mask M.

In this way the mask M is held fast without distortion.

Figure 4:
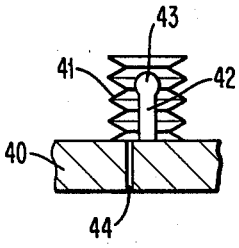
FIG. 4 illustrates a different embodiment of a clamp embodying the present invention.
Figure 5:
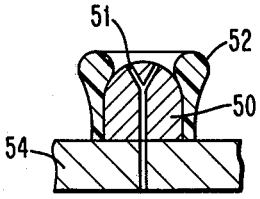
FIG. 5 illustrates a different embodiment of a clamp embodying the present invention.
Figure 6:
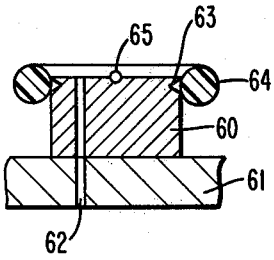
FIG. 6 illustrates a different embodiment of a clamp embodying the present invention.

FIGS. 4, 5 and 6 show other embodiments of the present invention which will serve to hold a mask in accordance with the tenants of this invention.

FIG. 4 shows mounted on a base plate 40 a hollow, flexible, bellows 41 surrounding a central post 42 which is provided with a rounded top 43. A conduit 44, for connecting a vacuum source (not shown) to the interior of the bellows 43 is protected through the base plate 40. In this case when a mask is placed over the top of the bellows it will fold down until the mask abuts the top surface 42 of the post 43 similar to that shown in FIG. 3.

FIG. 5 shows another embodiment of the invention. In this drawing there is shown a post 50, having an Y-topped central conduit 51 passing through the base plate 54 on which the post is mounted. The post is surrounded with a flexible sleeve 52 which has an open flared lip extending above the top rounded surface of the post 50. The sleeve 52 is formed of a flexible material such as rubber, plastic or the like, soft enough so that it will be crushed down whenever a body is placed over it and a vacuum is drawn through the conduit 51. By providing a Y-shaped conduit it will be assured that a vacuum can be drawn and that the object being clamped will not seal the conduit inadvertently.

FIG. 6 illustrates still another embodiment of the invention. In this figure a cylinder 60 is mounted on a base 61 and provided with an offset conduit 62. The top of the cylinder 60 is provided with a ring groove 63 in which a sealing ring 64 is seated. In the center of the ring 63 there is a ball 65 also set in its own seat provided in the cylinder 60.

It would also be understood that improvements, changes or modifications in form and detail could be made to the described embodiment without departing from the spirit and scope of the invention.

What is claimed is:

1. In a vacuum operating clamp for holding a workpiece in a fixed plane, plural workholding members of a fixed length fixedly mounted on a base, each of said workholding members having a concavity on its upper surface, a flexible sealing member on each of said workholding members around said surface, a ball in said concavity, and extending above the upper surface of said workholding member, means adapted to support the upper edge of the sealing member above the upper surface of said ball, and vacuum means passing through said workholding member through which a vacuum may be drawn between a workpiece overlying said flexible sealing member and said upper surface of said ball whereby said work is clamped onto and supported tangentially to said upper surface of said ball without distortion.

2. The clamp of claim 1 wherein said sealing member comprises an O ring and said support means comprises a groove around the periphery of said support member.

3. The clamp of claim 1 wherein said support means comprises a bellows co-axial with said workholding member.

4. In a vacuum operating clamp for holding a workpiece in a fixed plane, plural fixed length workholding members fixedly mounted on a base, each of said workholding members comprising an inner and an outer support said supports being co-axial supports with the outer support having a flat upper surface, the inner support having a convex upper surface extending above the surface of the outer support, and the outer support being provided with means adapted to support the upper edge of a flexible sealing member above and around the convex upper surface, and vacuum means between said inner and outer supports for drawing a vacuum between a workpiece overlying said flexible sealing member and said convex surface whereby said work is clamped onto and supported tangentially to said convex surface of said workholding member.

5. The clamp of claim 4 wherein said sealing member comprises an O ring.

6. The clamp of claim 5 wherein said outer support means is provided with a groove in which said sealing member comprised of an O ring is seated, said groove having a volume less than the volume of the O ring seated therein.

* * * * *